US008171757B2

(12) United States Patent
Dahlke

(10) Patent No.: US 8,171,757 B2
(45) Date of Patent: May 8, 2012

(54) DISPENSING SYSTEM FOR LIQUID OR VISCOUS TREATING AGENTS FOR USE IN A WASHING MACHINE, AND WASHING MACHINE

(75) Inventor: Dirk Dahlke, Rheda-Wiedenbrueck (DE)

(73) Assignee: Miele & Cie. KG, Guetersloh (DE)

( * ) Notice: Subject to any disclaimer, the term of this patent is extended or adjusted under 35 U.S.C. 154(b) by 451 days.

(21) Appl. No.: 12/255,519

(22) Filed: Oct. 21, 2008

(65) Prior Publication Data

US 2009/0100881 A1 Apr. 23, 2009

(30) Foreign Application Priority Data

Oct. 23, 2007 (DE) ..... 10 2007 050 920

(51) Int. Cl.
*D06F 39/02* (2006.01)

(52) U.S. Cl. ..... 68/17 R

(58) Field of Classification Search ..... 68/17 R, 68/12.18; 222/630, 394
See application file for complete search history.

(56) References Cited

U.S. PATENT DOCUMENTS

| | | | | |
|---|---|---|---|---|
| 3,602,015 | A * | 8/1971 | Hughes | 68/12.26 |
| 6,041,976 | A * | 3/2000 | Robertson | 222/333 |
| 6,564,968 | B1 * | 5/2003 | Terrell et al. | 222/63 |
| 7,544,289 | B2 * | 6/2009 | Straka et al. | 210/167.11 |
| 7,845,361 | B1 * | 12/2010 | Verespej et al. | 134/99.2 |
| 7,931,032 | B1 * | 4/2011 | Penkauskas et al. | 134/94.1 |
| 2002/0088502 | A1 | 7/2002 | Van Rompuy et al. | |
| 2003/0032930 | A1 * | 2/2003 | Branch | 604/298 |
| 2003/0106570 | A1 * | 6/2003 | Cerruti | 134/18 |
| 2004/0093913 | A1 * | 5/2004 | Bolduan et al. | 68/17 R |
| 2004/0155022 | A1 * | 8/2004 | Velinsky et al. | 219/213 |
| 2005/0126608 | A1 | 6/2005 | DeWeerd et al. | |
| 2005/0188730 | A1 * | 9/2005 | Zsambeki | 68/17 R |
| 2006/0272356 | A1 * | 12/2006 | LeMasters | 63/27 |
| 2007/0013405 | A1 * | 1/2007 | Gudin et al. | 324/765 |
| 2007/0084253 | A1 | 4/2007 | Ehrlich et al. | |
| 2010/0000025 | A1 * | 1/2010 | Dalton et al. | 8/137 |
| 2011/0174841 | A1 * | 7/2011 | Kennedy et al. | 222/182 |

FOREIGN PATENT DOCUMENTS

| | | |
|---|---|---|
| DE | 3216151 | 12/1982 |
| DE | 3302893 | 8/1984 |
| DE | 102005050083 | 4/2007 |
| DE | 102006043919 | 3/2008 |
| DE | 102006043973 | 3/2008 |
| DE | 102007022098 | 11/2008 |
| EP | 1731654 | 12/2006 |

* cited by examiner

*Primary Examiner* — Joseph L Perrin
(74) *Attorney, Agent, or Firm* — Leydig, Voit & Mayer, Ltd.

(57) ABSTRACT

A dispensing system for a liquid or viscous treating agent for use with a washing machine with a suds container configured to receive wash liquid. The dispensing system includes a dispenser box in communication with a water feed line. The dispenser box is configured to dispense treating agents to the suds container by flushing the treating agents out from the dispenser box. A receiving compartment is disposed in the dispenser box and is configured to receive a cartridge for holding a supply of the liquid or viscous treating agent. A dosing device configured to dispense the treating agent from the cartridge to the suds container is included in the dispensing system. The dosing device includes a linear displacement pump disposed on the cartridge. The linear displacement pump is configured to dispense a substantially constant volume of the treating agent from the cartridge with each stroke. The substantially constant volume of treating agent is a fraction of a total volume of treating agent for dispensing.

19 Claims, 5 Drawing Sheets

DISPENSING SYSTEM FOR LIQUID OR VISCOUS TREATING AGENTS FOR USE IN A WASHING MACHINE, AND WASHING MACHINE

CROSS REFERENCE TO RELATED APPLICATIONS

Priority is claimed to German patent application DE 10 2007 050 920.2, filed Oct. 23, 2007, which is hereby incorporated by reference herein.

FIELD

The present invention relates to a dispensing system for liquid or viscous treating agents, such as detergents or additives, for use in a washing machine including a suds container for receiving wash liquid and a dispenser box for treating agents.

BACKGROUND

In washing machines for domestic use, the detergent is usually manually introduced into a chamber and flushed with water into the suds container after the wash cycle has started. The user must observe the dosage instructions for the particular detergent used, and take care to fill the correct amount of treating agent into a chamber in the dispenser box.

To facilitate charging with liquid or viscous treating agents, such as detergents or fabric softeners, EP 1 731 654 A1 describes a dispensing system in which are inserted cartridges containing a supply of detergent or treating agent therein. The cartridges are respectively inserted into a chamber provided in the detergent dispenser drawer. A piston is pushed into the cartridge, moving the bottom portion of the cartridge inward so as to create a pressure which will press the detergent out of the opening located at the opposite end. Attached to the piston is a plunger which extends through the control panel to the exterior of the washing machine housing, and ends as a control knob. The amount of detergent to be dispensed is determined by the distance traveled by the piston as it is pressed into the cartridge, said distance being a portion of the total plunger distance to be pressed in. Here, the user must ensure that the proper amount of detergent dispensed in each time a dispensing operation is carried out.

To facilitate charging with detergent, automatic dispensing systems can be used in which a relatively large amount of detergent is stored in a supply container. Once a wash cycle is started, the preset amount of detergent will then be added to the wash liquid, which eliminates the need for the user to ensure that the proper amount of detergent is filled in each time a wash cycle is carried out. Such dispensing systems are frequently used especially in industrial washing machines.

German document DE 33 02 893 C2 describes a washing machine having a dispensing system for liquid detergents, which is disposed separately from the washing machine. The dispensing system includes a separate housing in which are fixedly installed two supply containers for additives and which accommodates a control device and the metering pump. Water from the suds container is conveyed through hose connections to the dispensing system, where the additive is added to this water. The water/additive mixture is pumped into the washing machine through a second conduit in region of the flush-in channel for fresh water supply. The dispensing system described therein is designed as a separate add-on unit, for which an additional, predetermined fixed place must be provided laterally adjacent to the washing machine. Connection of the dispensing system to the washing machine is via two hoses or pipes and a cable for power supply to the pump and for signal and/or data transmission. Space constraints make it difficult to access the containers for filling or cleaning.

Another dispensing system for liquid additives is described in DE 10 2005 050 083 A1. In that patent application, a supply container for liquid detergents is located outside the washing machine and connected thereto via a hose line. Disposed within the washing machine is the metering pump, which delivers the liquid or viscous detergent through a hose line to the lower region of the suds container. The metering pump is controlled by the washing machine controller which, based on the ON-time, determines the amount of detergent to be dispensed at any one time.

A dispensing system for liquid additives for use in a dishwasher is described in post-published documents DE 10 2006 043 973 A1 and DE 10 2006 043 919 A1. In those documents, a cartridge containing the treating agent is inserted into a receiving compartment of the dispensing system. The bottom of the cartridge is pierced by cannulas allowing the treating agent to pass from the cartridge to the treatment chamber. A controllable valve is used to dispense the predetermined amount, the amount delivered being determined by the opening time of the valve.

SUMMARY

In view of the above, an aspect of the present invention is to provide a dispensing system and a washing machine in such a way that they allow the use of different detergents or treating agents, while making dosing easy for the user.

In an embodiment, the present invention provides a dispensing system for a liquid or viscous treating agent for use with a washing machine with a suds container configured to receive wash liquid. The dispensing system includes a dispenser box in communication with a water feed line. The dispenser box is configured to dispense treating agents to the suds container by flushing the treating agents out from the dispenser box. A receiving compartment is disposed in the dispenser box and is configured to receive a cartridge for holding a supply of the liquid or viscous treating agent. A dosing device configured to dispense the treating agent from the cartridge to the suds container is included in the dispensing system. The dosing device includes a linear displacement pump disposed on the cartridge. The linear displacement pump is configured to dispense a substantially constant volume of the treating agent from the cartridge with each stroke. The substantially constant volume of treating agent is a fraction of a total volume of treating agent for dispensing.

BRIEF DESCRIPTION OF THE DRAWINGS

An exemplary embodiment of the present invention will be described in more detail below and is schematically shown in the drawings, in which.

DETAILED DESCRIPTION

Figure 1:
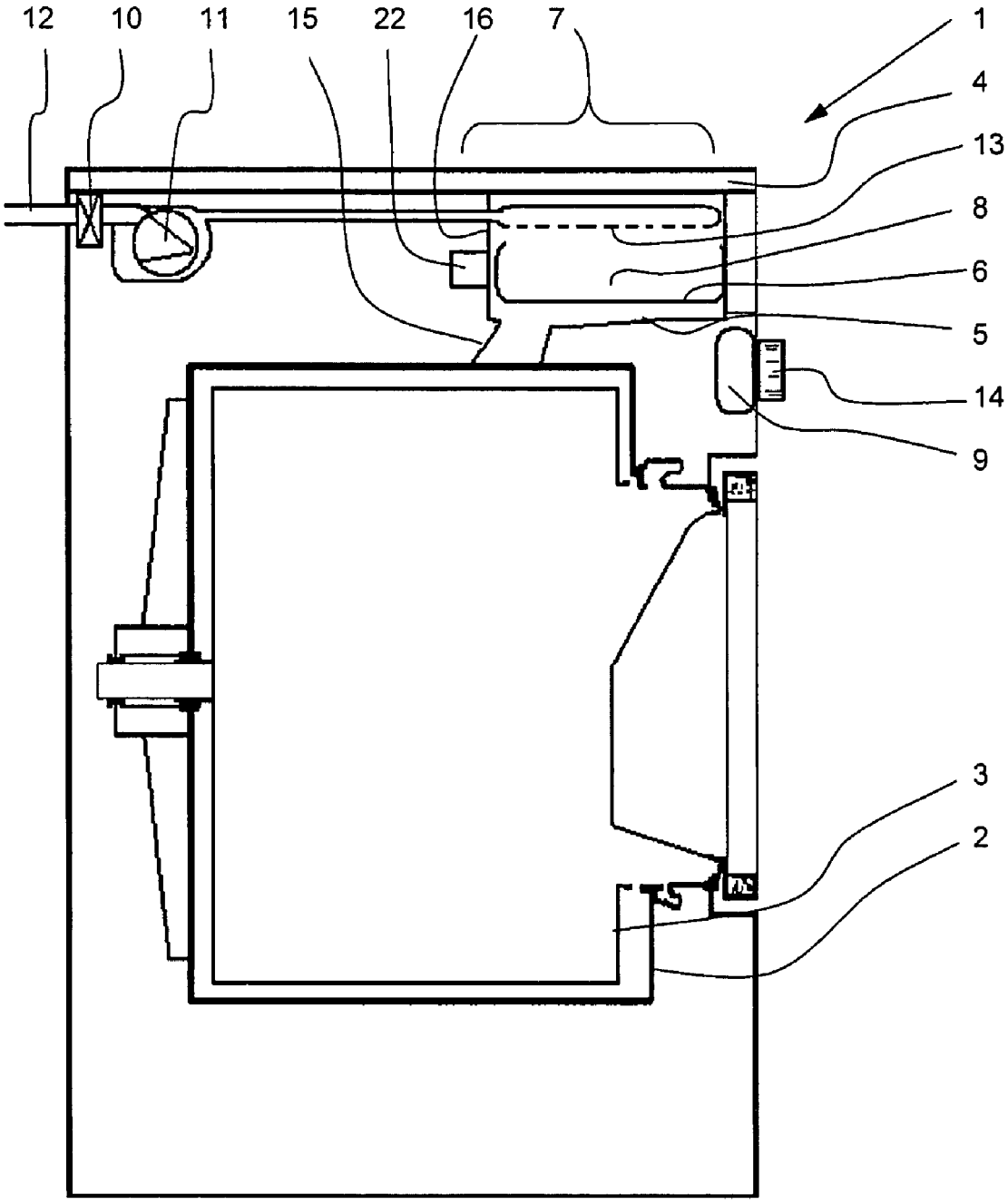
FIG. 1 is a schematic view of a washing machine having a dispensing system.

The present invention relates to a dispensing system for liquid or viscous treating agents, such as detergents or additives, for use in a washing machine including a suds container for receiving wash liquid, a dispenser box for treating agents, said dispenser box being in communication with the suds container via a water feed line, allowing the treating agent to be flushed out from the dispenser box, said dispenser box having at least one receiving compartment for a cartridge for holding a supply of a liquid or viscous treating agent, such as detergent or washing or rinse additives, the washing machine further including a dosing means allowing the treating agent to be dispensed from the cartridge into the suds container.

The present invention provides increased convenience and improved reliability in terms of washing results. The user may not need to estimate the amount of detergent each time a wash cycle is carried out, or manually fill the detergent into a compartment of the dispensing drawer. Further, the user can use different types of detergents, as desired. This is made possible by supply containers which are inserted into the dispensing system and can be easily replaced at any time. This means that supply containers which are not completely empty can also be removed from the compartment of the detergent drawer and replaced with another container, which may contain a different detergent or treating agent. This allows, for most of the laundry to be washed, that the appropriate detergent will be used in each case. If the supply container does not contain the detergent that would be needed for a particular treatment, the compartment which is normally used for insertion of the cartridge therein can be used as a conventional dispenser compartment to receive detergent for a single wash cycle.

A linear displacement pump provided on the cartridge is used as the dosing device, said linear displacement pump allowing a predetermined, substantially constant volume of a liquid or viscous treating agent to be dispensed from the cartridge with each stroke, the amount dispensed per stroke being a fraction of the total amount to be dispensed. The amount to be dispensed is determined by the strokes to be performed. The flushing into the suds container is effected by nozzles arranged above the receiving compartment or above the outlet of the pump, said nozzles flushing the liquid or viscous detergent out from this region, passing it into the suds container along with the water.

In an embodiment, the linear displacement pump is formed as a unit with the cartridge. When the cartridge is empty, it is replaced together with the pump. The user does not come into contact with the treating agent, and it is possible to prevent contamination occurring during refilling. Furthermore, the replacement of the cartridge together with the pump is particularly easy to do.

In an embodiment, the dosing device further includes an electrically powered actuator capable of imparting linear movement to the linear displacement pump. Automatic dispensing is accomplished by the actuator, so that the user only needs to ensure that a cartridge is inserted that contains a suitable detergent for the load of laundry to be washed.

In one embodiment, the actuator used is an electric motor with a screw drive. Such a drive mechanism can be of small size and yet capable of delivering sufficient force to operate the pump.

In another embodiment, an electrically operated solenoid is used as the actuator. A solenoid allows for rapid movement of the plunger, so that the dispensing operation does not take an excessive amount of time, especially when a large number of strokes need to be performed.

In another embodiment, the cartridge is held in place to a retaining plate in the receiving compartment by a retaining device, and is thereby prevented from being moved or displaced within the receiving compartment during single or repeated reciprocation of the pump.

For this purpose, in an embodiment, the retaining device includes a short tubular member which is attached to the cartridge or pump and has a slit, and which is inserted into a recess formed in the retaining plate, thereby holding the cartridge and pump in place within the receiving compartment. Thus, the cartridge can easily be placed into the receiving compartment, and at the same time prevented from being displaced in the direction of actuation during insertion. No additional fastening is required, which makes it very easy to remove the cartridge.

In an embodiment, the dispensing system includes a dispenser box accommodating a withdrawable drawer provided with the receiving compartment for the cartridge. In this embodiment, the dispensing system can be mounted in the appliance housing in place of the standard dispenser box. During cartridge replacement, the drawer is pulled out, allowing easy access to the receiving compartments from above.

In an embodiment, the actuator is disposed at the side of the dispenser box facing the interior of the appliance and exerts a force in the opening direction of the drawer. In order to prevent the drawer from being displaced as the pump is actuated, the dispensing system includes a movable retainer which is operatively connected to the actuator in such a manner that the drawer can be held in place within the dispenser box when the actuator is activated, and that the drawer can be released when the actuator is not activated.

In an embodiment, the retainer is pivotally mounted to the rear wall of the dispenser box. The retainer is provided at its underside with a projection having a slant, said projection and a pressure plate, which is movable by the actuator, being operatively connected in such a manner that the retainer is lowered when the actuator is activated, thereby holding the drawer in a retracted position. In this manner, the drawer can be prevented from being pulled out and be held in the retracted position when the actuator imparts a linear movement to the pump.

Conversely, when the actuator is not activated, the pressure plate acts on the projection, lifting the retainer, and thereby releasing the drawer. Thus, the drawer can be pulled out when no dispensing operation is taking place. For instance, when no wash cycle is activated, the drawer can be pulled out, making the receiving compartment accessible for insertion or removal of the cartridge.

In an embodiment, the amount of treating agent to be dispensed for a wash cycle is such that it corresponds to one stroke or several strokes of the linear displacement pump. This allows for very accurate adjustment of the dosing of the type, amount and/or soil level of the laundry that has been filled in.

In an embodiment, a substantially constant volume can be delivered with each stroke, said volume being in the range of from 3 ml to 10 ml. Thus, the amount of treating agent required can be dispensed in relatively small increments, without requiring an excessive number of strokes. For example, if the volume delivered with each stroke is 4 ml, only 10 strokes are required to dispense an amount of 40 ml of treating agent.

In another embodiment, the cartridge has a capacity of 250 to 1500 ml. Depending on the dosage instructions, this capacity makes it possible to perform several (in this case about 10 to 20) dispensing operations with one cartridge. Furthermore, the amount is such that the cartridge it will not remain in service too long even when infrequently used, thus preventing, or substantially preventing, unfavorable changes, such as drying of or formation of flakes in the treating agent.

The outer shape of the cartridge can be matched to the inner shape of the receiving compartment, thus making optimum use of the space available in the receiving compartment.

The present invention also relates to a washing machine including a housing containing a suds container for receiving wash liquid, and further including a controller and a dispensing system, as described above, which is disposed in the upper portion of the housing and used for liquid or viscous treating agents or detergents, said controller being adapted to control the dispensing system. The dispensing system can be mounted in a conventional washing machine in place of the dispenser box without any or with only slight modifications having to be made to the structural configuration thereof. The controller is capable of controlling the electrically powered actuator in a manner allowing the dispensing of the required amount of treating agent to be performed automatically, taking into account the type, amount and soil level of the laundry.

Referring to FIG. 1, the illustrated washing machine 1 includes a suds container 2 in which is rotatably mounted a drum 3 which is driven by an electric motor and which allows the load of laundry located in drum 3 to be agitated in the detergent solution within suds container 2. Also disposed within housing 4 of washing machine 1 is a dispensing system 7 including a dispenser box 5 which contains a drawer 6 having at least one compartment 8 for receiving a cartridge 17 (FIG. 2) for holding a supply of detergent or treating agent for several wash cycles. Dispensing system 7 includes a plurality of feed nozzles 13 which are arranged above dispenser box 5 and are in communication with a water feed line 12, with a solenoid valve 10 and/or a water distributor 11 interposed therebetween, and which allow detergent or treating agent to be flushed into suds container 2. Suds container 2 is connected to dispenser box 5 via a flexible tube 15. The additives used may be, for example, liquid or viscous detergents, washing additives or rinse additives, such as fabric softener.

Solenoid valve 10, water distributor 11, and dispensing system 7 and, in particular, the electrically operated actuator 22, are controlled by controller 9 of washing machine 1, which also controls the wash cycle sequence, so that the amount to be dispensed is determined according to the selected wash cycle or the programmed sequence of steps constituting the wash cycle. The selection of the wash cycle is accomplished using control handle 14, which may also be used to set the reference amounts to be dispensed. The reference amount may be communicated to the controller as the number of strokes needed to provide the amount of treating agent to be dispensed for a maximum, normally soiled load in accordance with standard instructions of the treating agent manufacturer.

Figure 2:
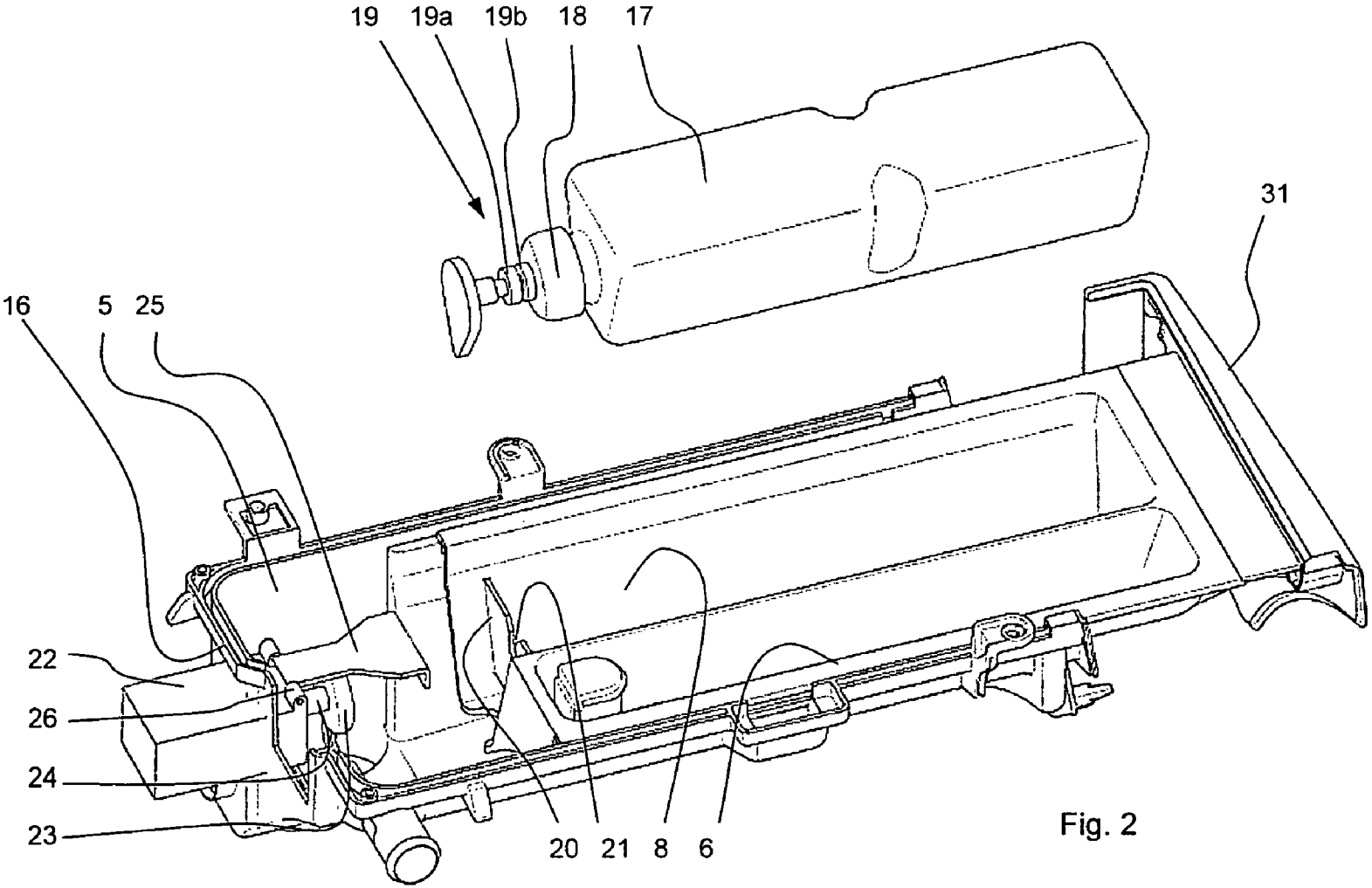
FIGS. 2 and 3 are detail views of the dispensing system.

FIG. 2 shows, in a detail view, dispenser box 5 and the component parts thereof. Dispenser box 5 contains a sliding drawer 6 having at least one receiving compartment 8 for a cartridge 17. In this view, cartridge 17 is shown removed from receiving compartment 8. Drawer 6 has a handle plate 31 on the side facing the user, allowing the user to easily withdraw drawer 6 from dispenser box 5. On the side facing the interior of the appliance, drawer 6 has a retaining plate 20 having a recess 21 formed in the edge thereof. Retaining device 19, which includes a short tubular member 19*a* which is attached to cartridge 17 or pump 18 and has a slit 19*b*, is inserted into the aforementioned recess. Slit 19*b*, into which projects the edge of opening 21, enables cartridge 17, or pump 18, to be retained and fixed in position relative to the direction of actuation. Actuator 22 is attached to rear wall 16 of dispenser box 5. During actuation of pump 18, the aforementioned actuator transmits its linear movement thereto via a plunger 24 and a pressure plate 23. Pump 18 functions as a dosing means, because it allows a constant, or at least substantially constant, volume of treating agent to be dispensed from cartridge 17 with each stroke. A retainer 25 is pivotally mounted to rear wall 16 of dispenser box 5 by a hinge 26 to prevent drawer 6 from being displaced and, in particular, from being withdrawn from dispenser box 5 during the dispensing operation. Cartridge 17 and pump 18 together form a unit, which is also referred to as dispenser.

Figure 3:
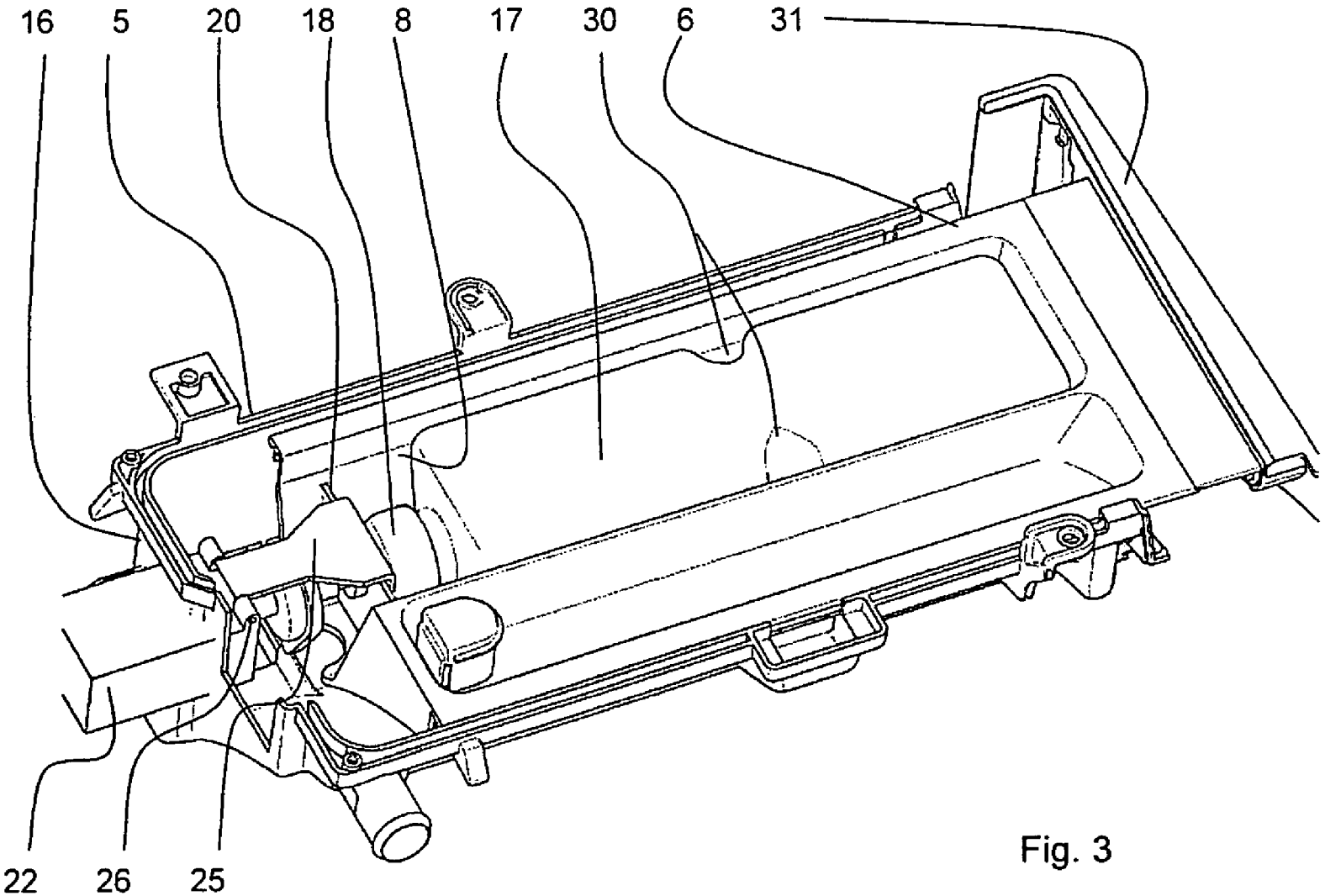

In FIG. 3, dispenser box 5 is shown with drawer 6 in a retracted position, and with cartridge 17 located in receiving compartment 8, ready to dispense the treating agent contained in cartridge 17 by means of linear displacement pump 18. Retainer 25 engages behind retaining plate 20, thereby preventing drawer 6 from being displaced. The cartridge 17 has an outer shape that substantially corresponds to the shape of receiving compartment 8, allowing it to be completely inserted therein. In order to facilitate removal, cartridge 17 has two indentations 30 in opposite side faces, providing a better grip for the user.

Figure 4:
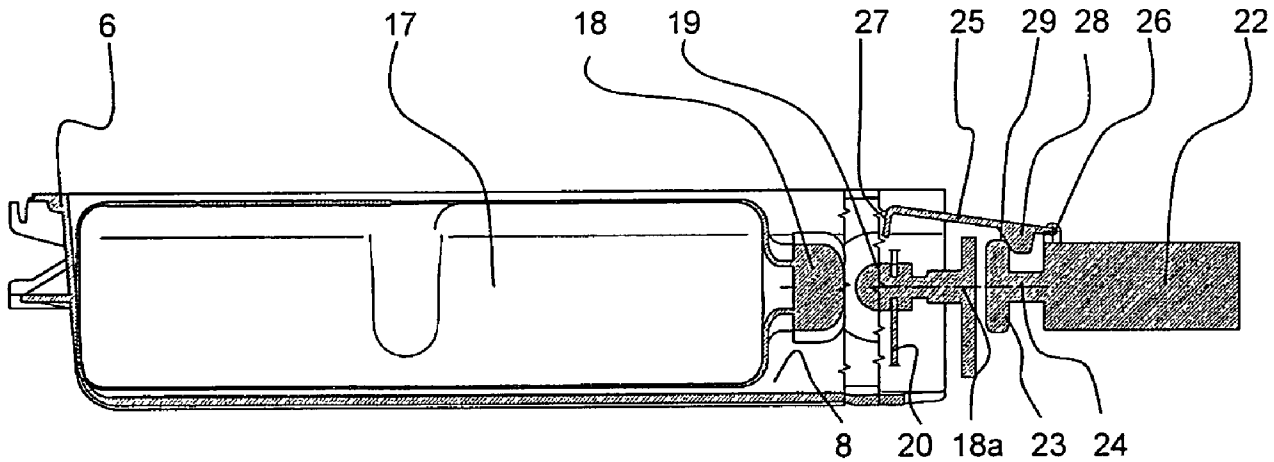
FIGS. 4 and 5 are cross-sectional views of the dispensing system.

In the cross-sectional view of FIG. 4, dispensing system 7 is shown with drawer 6 in a released position. Actuator 22, which is attached to rear wall 16 of dispenser box 5, has retracted the plunger 24 and pressure plate 23, and does not exert any pressure on actuating part 18*a* of pump 18. Retainer 25 is pivotally mounted to rear wall 16 (FIG. 3) of dispenser box 5 (FIG. 3) by a hinge 26. A projection 28 formed on the underside of retainer 25 and directed toward pressure plate 23 or, to be more precise, the slant 29 of projection 28, rests on pressure plate 23 and, therefore, retainer 25 is lifted. In this position, a flange 27 of retainer 25, which faces retaining plate 20, can no longer engage behind retaining plate 20 and, therefore, drawer 6 can be pushed away from actuator 22 and rear wall 16 (FIG. 3). Cartridge 17 occupies nearly the entire receiving compartment 8, and is positioned and held in place to retaining plate 20 by retaining means 19.

Figure 5:
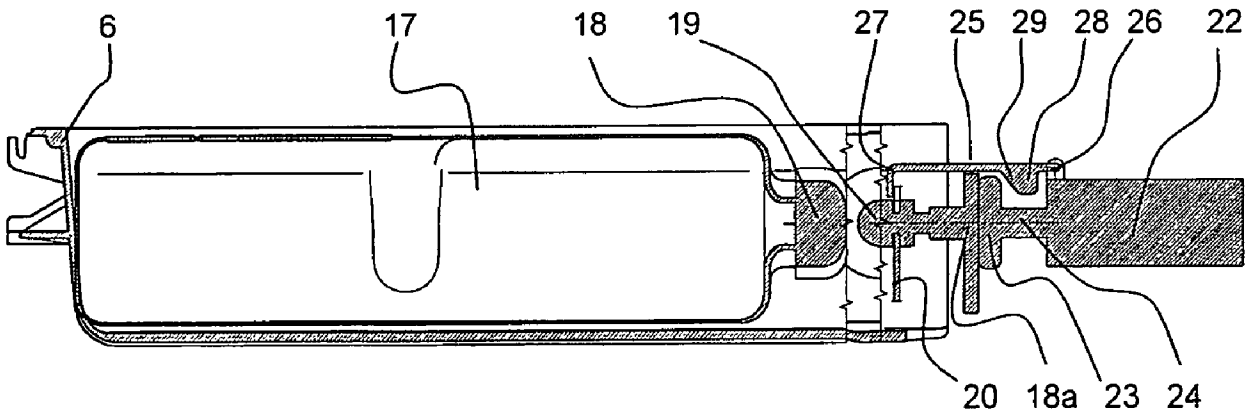

In the cross-sectional view of FIG. 5, dispensing system 7 is shown with drawer 6 in a fixed position. Actuator 22, which is attached to rear wall 16 of dispenser box 5, has extended the plunger 24 and pressure plate 23, and exerts a pressure on actuating part 18*a* of pump 18. Retainer 25 is pivotally mounted to rear wall 16 (FIG. 3) of dispenser box 5 (FIG. 3) by means of a hinge 26. Projection 28, which is formed on the underside of retainer 25 and directed toward pressure plate 23 or, to be more precise, the slant 29 of projection 28, no longer rests on pressure plate 23 and, therefore, retainer 25 is lowered. In this position, flange 27 of retainer 25, which faces retaining plate 20, can engage behind retaining plate 20 and, therefore, drawer 6 can no longer be pushed away from actuator 22 and rear wall 16 (FIG. 3).

Figure 6:
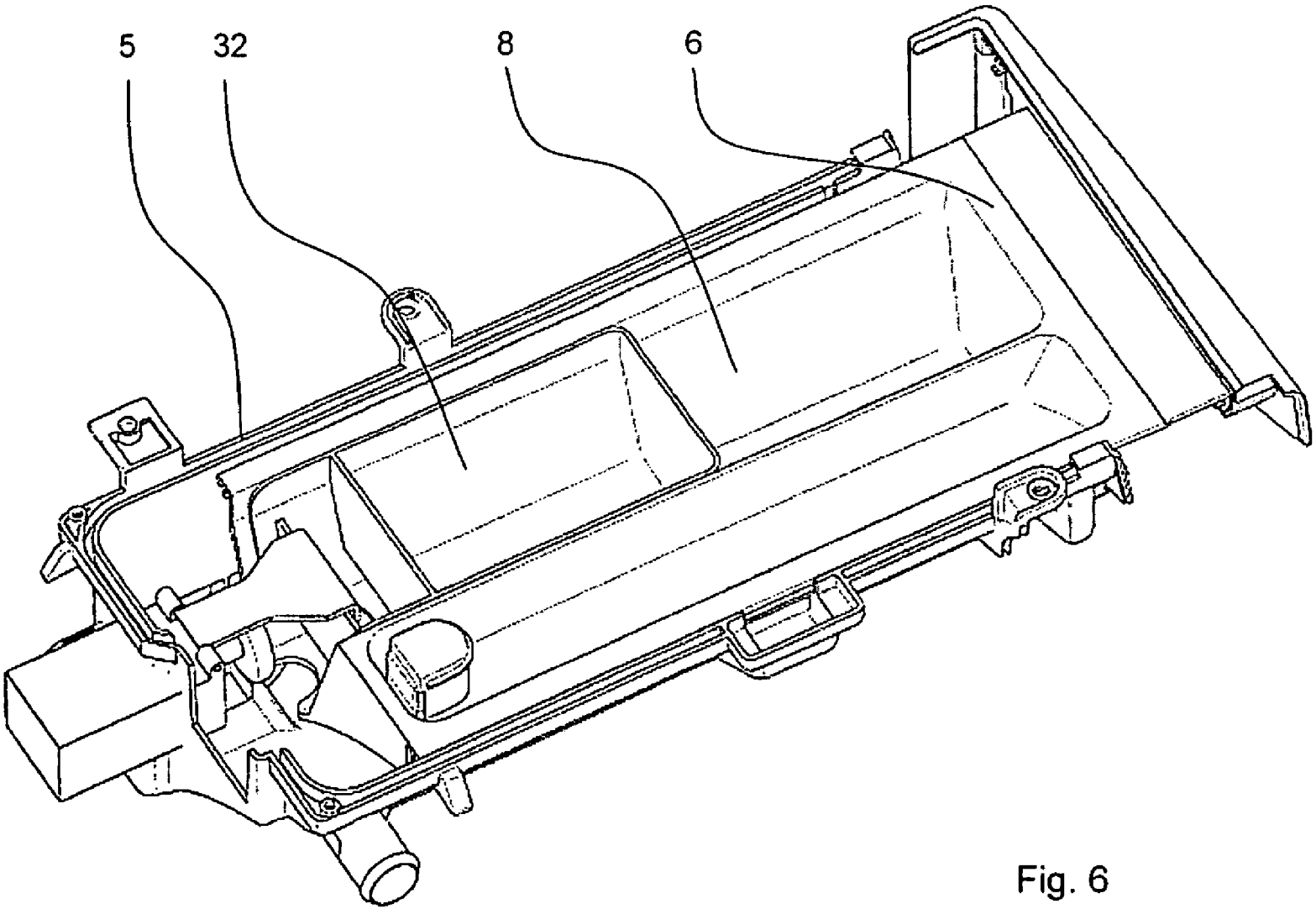
FIG. 6 is a view showing the dispensing system used without a cartridge.

FIG. 6 shows dispenser box 5 and drawer 6 in a condition when dispensing is done without using cartridge 17 (FIG. 2). In this case, receiving compartment 8 can be used to hold a supply of treating agent, such as powdered detergent, for one wash cycle. In order to allow treating agent to be flushed in during different phases of the wash cycle, for example, one portion during the pre-wash operation and another portion during the main-wash operation, an additional receptacle 32 is inserted into receiving compartment 8; and feed nozzles 13 (FIG. 1) for receiving compartment 8 and feed nozzles 13 (FIG. 1) are controlled separately, allowing the compartments to be flushed separately.

What is claimed is:

1. A dispensing system for liquid or viscous treating agents for use with a washing machine including a suds container configured to receive wash liquid, the dispensing system comprising:

a dispenser box in communication with water feed line and configured to dispense treating agents to the suds container by flushing the treating agents out from the dispenser box;

a receiving compartment disposed in the dispenser box and configured to receive a cartridge for holding a supply of the liquid or viscous treating agent; and a dosing device configured to dispense the treating agent from the cartridge to the suds container, the dosing device including a linear displacement pump disposed on the cartridge, the linear displacement pump being configured to dispense a substantially constant volume of the treating agent from the cartridge with each reciprocating stroke of the linear displacement pump and an electrically powered actuator configured to impart reciprocating linear movement to the linear displacement pump so as to provide metered dispensing of the treating agent, wherein the substantially constant volume of treating agent is a fraction of a total volume of treating agent dispensed in a wash cycle.

2. The dispensing system as recited in claim 1 wherein the treating agent is at least one of a detergent and an additive.

3. The dispensing system as recited in claim 1 wherein the linear displacement pump and cartridge are insertable into the receiving compartment as a unit.

4. The dispensing system as recited in claim 1 wherein the electrically powered actuator includes an electric motor and a screw drive.

5. The dispensing system as recited in claim 1 wherein the electrically powered actuator includes an electrically operated solenoid.

6. The dispensing system as recited in claim 1 where in the cartridge is fixed to a retaining plate in the receiving compartment with a retaining device.

7. The dispensing system as recited in claim 6 wherein the retaining device includes a short tubular member attached to one of the cartridge and linear displacement pump, the short tubular member including a slit, the short tubular member being insertable into a recess disposed in the retaining plate so as to fix in place the cartridge and linear displacement pump are fixed in place within the receiving compartment.

8. The dispensing system as recited in claim 1 further comprising a removable drawer configured to be pulled out from the dispenser box, the drawer including the receiving compartment for the cartridge.

9. The dispensing system as recited in claim 1 further comprising a removable drawer configured to be pulled out from the dispenser box, the drawer including the receiving compartment for the cartridge.

10. The dispensing system as recited in claim 9 further comprising a movable retainer connected to the electrically powered actuator such that the drawer is secured in the dispenser box when the electrically powered actuator is activated and removable when the electrically powered actuator is not activated.

11. The dispensing system as recited in claim 10 wherein the retainer is pivotally disposed on a rear wall of the dispenser box and an underside of the retainer includes a projection having a slant, and wherein a pressure plate that is moveable by the actuator is operatively connected to the projection such that the retainer is configured to be lowered when the actuator is activated thereby securing the drawer in a retracted position.

12. The dispensing system as recited in claim 10 wherein the retainer is pivotally disposed on a rear wall of the dispenser box and an underside of the retainer includes a projection having a slant, and wherein a pressure plate that is moveable by the actuator is operatively connected to the projection such that the retainer is configured to be disposed in a lifted position when the actuator is not activated such that the drawer is removable.

13. The dispensing system as recited in claim 1 wherein one or more strokes of the linear displacement pump corresponds to a wash cycle of the washing machine.

14. The dispensing system as recited in claim 13 wherein the substantially constant volume of treating agent is in a range of 3 ml to 10 ml.

15. The dispensing system as recited in claim 1 wherein the cartridge has a capacity in a range of 250 ml to 1500 ml.

16. The dispensing system as recited in claim 1 the cartridge has an outer shape matching an inner shape of the receiving compartment.

17. A washing machine comprising:

a housing;

a suds container disposed in the housing and configured to receive wash liquid;

a dispensing system disposed in an upper portion of the housing and configured for use with a liquid or viscous treating agent, the dispensing system comprising:

a dispenser box in communication with water feed line and configured to dispense treating agents to the suds container by flushing the treating agents out from the dispenser box;

a receiving compartment disposed in the dispenser box and configured to receive a cartridge for holding a supply of the liquid or viscous treating agent; and a dosing device configured to dispense the treating agent from the cartridge to the suds container, the dosing device including a linear displacement pump disposed on the cartridge, the linear displacement pump being configured to dispense a substantially constant volume of the treating agent from the cartridge with each reciprocating stroke of the linear displacement pump and an electrically powered actuator configured to impart reciprocating linear movement to the linear displacement pump so as to provide metered dispensing of the treating agent, the substantially constant volume of treating agent being a fraction of a total volume of treating agent dispensed in a wash cycle; and a controller configured to control the dispensing system.

18. A dispensing system for liquid or viscous treating agents for use with a washing machine including a suds container configured to receive wash liquid, the dispensing system comprising:

a dispenser box in communication with water feed line and configured to dispense treating agents to the suds container by flushing the treating agents out from the dispenser box;

a receiving compartment disposed in the dispenser box and configured to receive a cartridge for holding a supply of the liquid or viscous treating agent; and a dosing device configured to dispense the treating agent from the cartridge to the suds container, the dosing device including an electrically powered actuator configured to impart reciprocating linear movement to a linear displacement pump disposed on the cartridge so as to dispense a constant volume of treating agent with each reciprocating stroke of the linear displacement pump, the constant volume being a fraction of a total volume of treating agent dispensed in a wash cycle, so as to provide a metered dispensing of the treating agent.

19. The dispensing system as recited in claim 18, wherein the electrically powered actuator includes at least one of an electrically operated solenoid and a drive unit including an electrically powered motor and a screw drive.

* * * * *